US010053255B2

(12) United States Patent
Murray et al.

(10) Patent No.: US 10,053,255 B2
(45) Date of Patent: Aug. 21, 2018

(54) FITMENT DELIVERY SYSTEM

(71) Applicant: Pouch Pac Innovations, LLC, Sarasota, FL (US)

(72) Inventors: R. Charles Murray, Sarasota, FL (US); Olaf Clemens, Wipperfurth (DE)

(73) Assignee: SN Maschinenbau GmbH, Wippenfuerth (DE)

( * ) Notice: Subject to any disclaimer, the term of this patent is extended or adjusted under 35 U.S.C. 154(b) by 545 days.

(21) Appl. No.: 14/703,152

(22) Filed: May 4, 2015

(65) Prior Publication Data

US 2015/0314901 A1 Nov. 5, 2015

Related U.S. Application Data

(60) Provisional application No. 61/987,800, filed on May 2, 2014.

(51) Int. Cl.

| | |
|---|---|
| ***B65B 61/18*** | (2006.01) |
| ***B65B 43/46*** | (2006.01) |
| ***B65B 43/50*** | (2006.01) |
| ***B31B 70/84*** | (2017.01) |

(52) U.S. Cl.

CPC ..... *B65B 61/186* (2013.01); *B31B 70/844* (2017.08); *B65B 43/465* (2013.01); *B65B 43/50* (2013.01)

(58) Field of Classification Search

CPC ..... B65B 43/30; B65B 43/32; B65B 43/465; B65B 43/50; B65B 61/186; B31B 70/84; B31B 70/844

USPC ..... 53/133.1, 133.2; 493/212, 213, 929

See application file for complete search history.

(56) References Cited

U.S. PATENT DOCUMENTS

| | | | | |
|---|---|---|---|---|
| 3,102,332 A * | 9/1963 | Porcelli | B65B 7/2807 53/133.2 |
| 4,027,577 A * | 6/1977 | Thompson et al. | B29C 65/04 493/212 |
| 4,817,363 A * | 4/1989 | St. Clair | B65B 61/186 53/300 |
| 5,024,645 A * | 6/1991 | Soubrier et al. | B29C 65/02 493/213 |

(Continued)

FOREIGN PATENT DOCUMENTS

| | | | | |
|---|---|---|---|---|
| DE | 202013103622 * | 9/2013 | B31B 70/844 |
| WO | WO 9302923 A1 * | 2/1993 | B65B 61/186 |
| WO | WO 2012139371 A1 * | 10/2012 | B65B 61/186 |

*Primary Examiner* — Stephen F Gerrity

(74) *Attorney, Agent, or Firm* — Dinsmore & Shohl LLP

(57) ABSTRACT

A fitment delivery system for delivering a fitment to an open pouch is provided. The fitment delivery system includes a conveyor disposed along a loop. A plurality of carriers are mounted to the conveyor. A fitment deliverer includes a chute configured to accumulate a predetermined number of fitments in a line and to individually drop the fitments into one of the plurality of carriers. A fitment heater is disposed downstream the fitment deliverer and is configured to heat the fitment to a predetermined temperature. A fitment inserter is disposed downstream the fitment heater. The fitment inserter includes an arm support and a pair of fitment grippers mounted on opposite ends of the arm support. The fitment inserter positioned with respect to the conveyor so as to both pick up and insert the fitment into the pouch at the same time.

12 Claims, 9 Drawing Sheets

(56) References Cited

U.S. PATENT DOCUMENTS

| | | | | |
|---|---|---|---|---|
| 5,484,374 | A * | 1/1996 | Bachner et al. | B29C 65/08 53/133.2 |
| 6,045,493 | A * | 4/2000 | Totani | B65H 5/10 493/212 |
| 6,205,746 | B1 * | 3/2001 | Moss et al. | B65B 61/186 53/133.2 |
| 6,810,636 | B2 * | 11/2004 | Resterhouse | B29C 65/02 53/133.2 |
| 2002/0116902 | A1 * | 8/2002 | Skinner et al. | B65B 61/186 53/133.2 |
| 2003/0233812 | A1 * | 12/2003 | Rogers | B65B 61/186 53/133.2 |
| 2008/0254962 | A1 * | 10/2008 | Mizuo et al. | B29C 65/02 493/179 |
| 2010/0192367 | A1 * | 8/2010 | Kishimoto | B31B 70/00 29/773 |

* cited by examiner

FITMENT DELIVERY SYSTEM

CROSS-REFERENCE TO RELATED APPLICATIONS

This application claims priority of U.S. Provisional Application 61/987,800 filed May 2, 2014, the contents of which are incorporated herein by reference.

TECHNICAL FIELD

A system configured to reduce down time of pouch manufacturing and improve the quality of sealing the fitment to the pouch is provided.

BACKGROUND OF THE INVENTION

Fitments are used for accessing the contents of packaging such as flexible pouches. These fitments typically have a spout extending from a base or canoe portion which is sealed to a portion of the pouch. The spout frequently has some type of closure such as a cap. A variety of sizes and shapes of fitments are used.

When the pouches are formed, the fitment is typically delivered to a bowl feeder. The bowl feeder is used to orientate and align the fitments so that a robotic arm can pick up the fitment from the bowl feeder and place the fitment into the pouch. Thus, it should be appreciated that currently only one fitment may be picked up at a time from the bowl feeder. Thus, if the bowl feeder does not properly orient and align a fitment for the robotic arm, the robotic arm must wait and the system stalls. Accordingly, it remains desirable to have a system wherein the fitments may accumulate so as to always have a fitment ready for insertion into the pouch thereby reducing stop time.

Sealing the fitment to the pouch requires sufficient heat to partially melt the laminate onto the fitment as well as heat the fitment to receive the laminate material. Currently, systems heat both the fitment and the laminate material at the same time. This may result in an ill formed seal in instances where the fitment does not achieve a predetermined temperature. In other instances the fitment itself may crack. Accordingly, it remains desirable to have a system wherein the fitment is heated to a predetermined temperature prior to being sealed to the pouch.

SUMMARY OF THE INVENTION

A system for reducing down time of pouch manufacturing and improving the quality of sealing the fitment to the pouch is provided. The system includes a conveyor driven along a closed loop. The system further includes a fitment delivery system, a plurality of carriers, a fitment inserter and a fitment heater.

The carriers are mounted to the conveyor. The fitment delivery system, the fitment inserter and the fitment heater are disposed along the conveyer. The fitment heater is downstream of the fitment delivery system and the fitment inserter is downstream from the fitment heater.

The carrier carries fitments from the fitment delivery system to the fitment heater, wherein the fitments are heated prior to being inserted into the pouch. The conveyer drives the carrier with the heated fitment to the fitment inserter wherein the fitment inserter picks up the fitment from the carrier and inserts the fitment into the opening of a pouch.

The fitment delivery system includes a chute. The chute is mounted to a bowl feeder. The chute is configured to hold a plurality of fitments in a line so as to allow the fitments delivered by the bowl feeder to accumulate therein. The fitment delivery system further includes a fitment deliverer. The fitment deliverer is operatively attached to the chute so as to control the delivery of a fitment from the chute. The fitment deliverer may be controlled by a programmable logic controller which is configured to actuate the fitment deliverer so as to dispense a fitment when a carrier is positioned to receive the fitment.

The chute includes an elongated portion configured to allow a predetermined number of fitments to be stored therein. The chute further includes an arcuate end portion disposed on the distal end of the elongated portion so as to allow the fitment to drop into the carrier. The fitment deliverer moves the fitment from the elongated portion to the arcuate portion wherein gravity drops the fitment into the carrier.

The conveyor moves the carrier with the fitment downstream from the loop to the fitment heater. The fitment heater is a heating unit having a heat emitting surface disposed a predetermined distance from the path of the conveyor. As the carrier moves past the fitment heater, the fitment is warmed to a predetermined temperature.

The conveyor then moves the carrier past the fitment heater to the fitment inserter. The fitment inserter is disposed between the fitment delivery system and a pouch forming system. The pouch forming system includes pouch grippers configured to hold the pouch. The pouch forming system includes a pouch opening station and a fitment sealing station. The pouch is opened so as to receive a fitment. The pouch forming system then moves the open pouch to the fitment sealing station wherein the fitment inserter picks a fitment from the carrier and places the fitment into the pouch opening. Seal bars enclose the fitment, sealing the fitment to the pouch.

The fitment inserter includes an arm support rotatably mounted to a piston. The piston is configured to drive the arm support between an up and down position. The arm support includes a pair of fitment grippers, the fitment grippers are configured to pick up a fitment from the carrier and also insert a fitment into an opening of the pouch body.

The piston moves the arm support between an up and down position. In the down position, each of the fitment grippers holds a fitment. One of the fitment grippers grabs a fitment from the carrier and the other of the fitment grippers places a fitment within an opening of the pouch. The fitment inserter leaves the arm support in the down position long enough to allow the fitment sealing station to seal the fitment to the pouch. Fitment inserter moves the arm support to the up position wherein the fitment sealed to the pouch remains held by the pouch gripper and is released by the corresponding fitment gripper. Simultaneously, the fitment in the carrier is picked up by the corresponding fitment gripper.

The arm support is then rotated 180 degrees thus the empty gripper is positioned above the conveyor, simultaneously, the conveyor is indexed so as to move a carrier with a fitment generally underneath the empty fitment gripper. The fitment gripper holding a fitment is positioned above the pouch forming station. As the arm support is turned, the pouch forming system moves an open pouch to the fitment sealing station. It should be appreciated that movement of the conveyor, pouch system, and fitment inserter are synchronized such that an empty fitment gripper is positioned above a carrier holding a fitment and the fitment gripper holding a fitment is position above an open pouch.

The arm support is then moved to the down position wherein the empty fitment gripper engages a fitment from the carrier and the fitment gripper carrying a fitment places the fitment into the opening of the pouch. The fitment is then sealed to the pouch and the cycle continues as described above.

Accordingly, the fitment delivery system is configured to reduce down time for manufacturing pouches with fitments by providing a chute for which fitments may accumulate, improves the process of sealing the fitment to the pouch by preheating the fitment before the sealing process, and increases the efficiency of pouch formation by having a single device configured to both pick up and insert a fitment into the pouch.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

A fitment delivery system for reducing down time of pouch manufacturing and improving the quality of sealing the fitment to the pouch is provided. The fitment delivery system includes a fitment deliverer configured to accumulate a plurality of fitments and deliver an individual fitment to a respective carrier. Thus, by accumulating the fitments the fitment delivery system prevents down time caused when a fitment is not properly position to be received by a robotic arm.

The fitment delivery system further includes a fitment heater. The fitment heater is downstream of the fitment deliverer. The fitment heater is configured to heat the fitments prior to being inserted into the pouch. Accordingly, the fitments are at an optimal temperature for pouch sealing operations and thus the system reduces cracks in the fitment which may occur when a fitment is too cold for sealing operations.

The fitment delivery system further includes a fitment inserter. The fitment inserter is configured to both pick up and insert the fitment into the pouch at the same time. The fitment inserter includes an arm support and a pair of fitment grippers disposed on each end of the arm support. The arm support is rotatable mounted to a piston. The piston is configured to drive the arm support between an up position and a down position. Accordingly, the fitment delivery system increases the efficiency of pouch formation by having a single device configured to both pick up and insert a fitment into the pouch.

Figure 1:
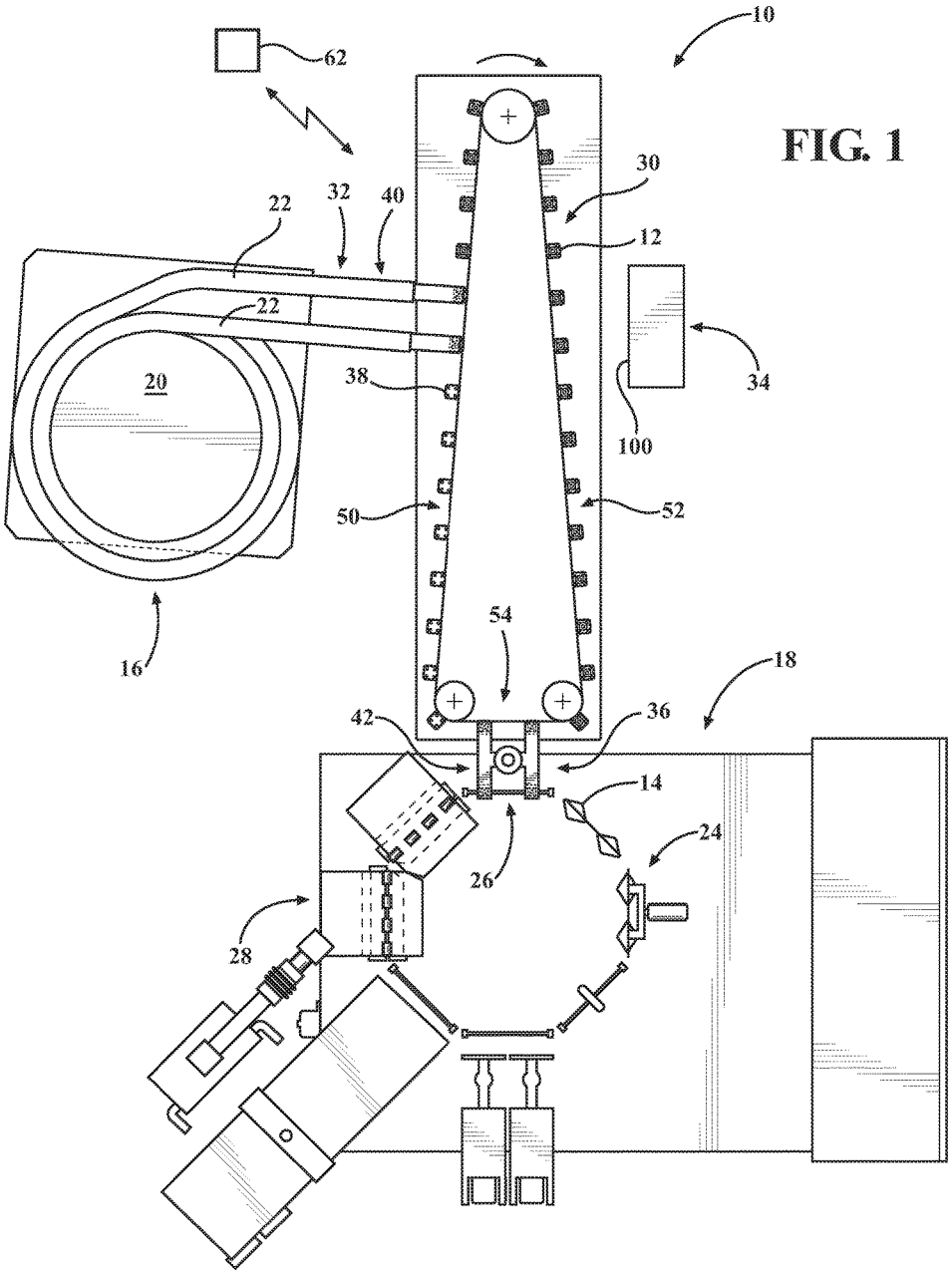
FIG. 1 is top down view of a fitment delivery system and the pouch forming station.

With reference now to FIG. 1, a fitment delivery system 10 for reducing down time of pouch 14 manufacturing and improving the quality of sealing the fitment 12 to the pouch 14 is provided. The term fitment 12 as used herein may reference the spout individually or the spout with the cap. The spout provides access to the contents of the pouch 14. In some cases, the pouch 14 may be fitted with a cap to close the spout. The fitment delivery system 10 may be used with a bowl feeder 16 and a pouch forming system 18.

The bowl feeder 16 includes a bowl 20 configured to receive a plurality of fitments 12. The bowl 20 vibrates and rotates the fitments 12 and feed the fitments 12 to an output channel 22, wherein the fitments 12 are positioned to be inserted into a pouch 14. For illustrative purposes, the bowl feeder 16 is shown as having two output channels 22, however it should be appreciated that that the bowl feeder 16 may have only one output channel 22 or more than two output channels 22, and the number of output channels 22 shown are provided for illustrative purposes only and is not intended to limit the scope of the appended claims.

The pouch forming system 18 includes a plurality of stations configured to form a pouch 14. The pouch forming system 18 includes a pouch opening station 24 where the pouch 14 is opened, a fitment sealing station 26 where the fitment 12 is sealed to the pouch 14, and a pouch filling station 28 wherein the pouch 14 is filled. It should be appreciated that the pouch 14 may be filled through the fitment 12 or may be filled through the pouch opening before the fitment 12 is sealed thereto.

Figure 2:
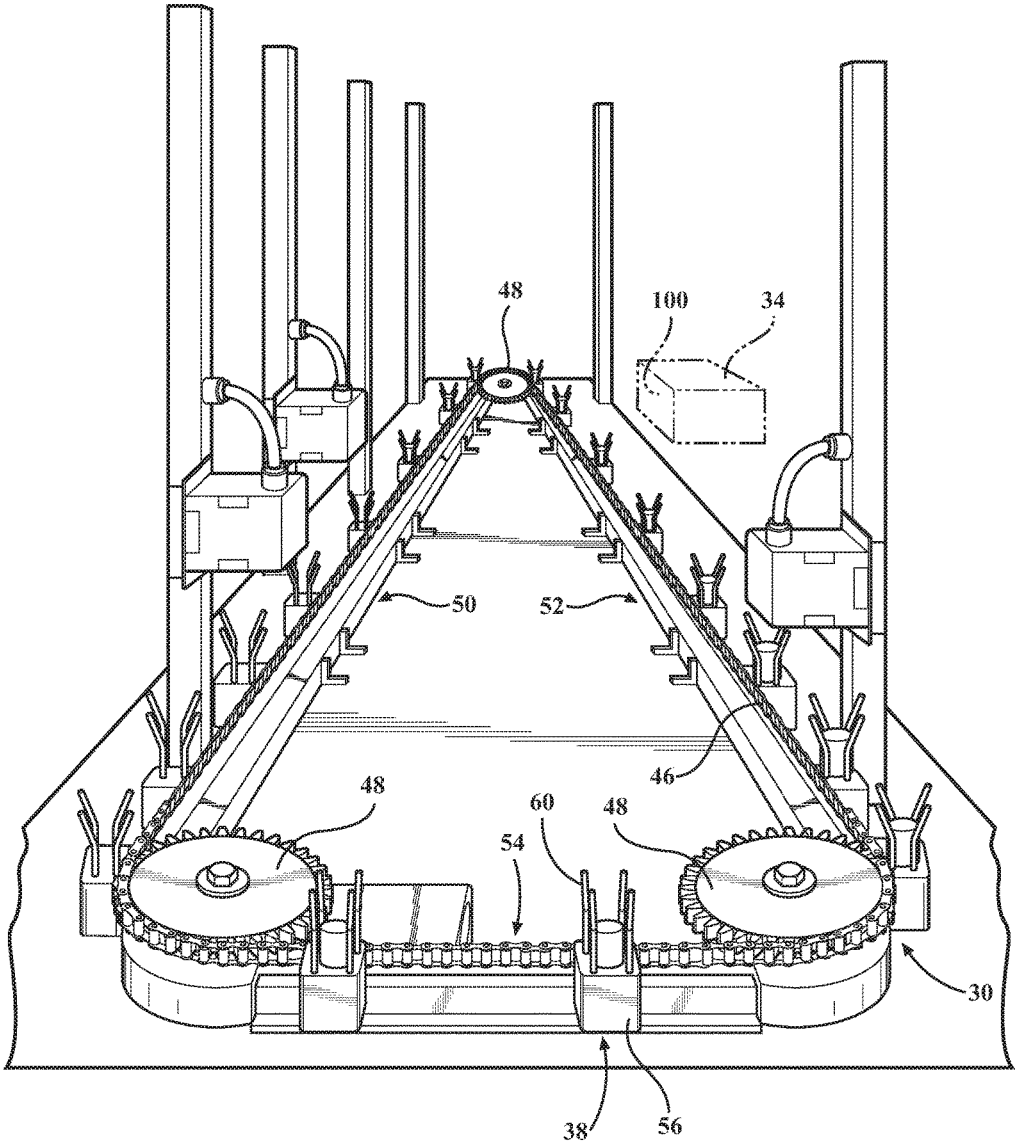
FIG. 2 is a perspective view of the fitment delivery system.

With reference to FIG. 1 and also to FIG. 2, the system includes a conveyor 30 driven along a closed loop, a fitment deliverer 32, a fitment heater 34, and a fitment inserter 36. The fitment deliverer 32 positioned with respect to the conveyor 30 so as to individually drop the fitments 12 into one of the plurality of carriers 38. The fitment deliverer 32 includes a chute 40 configured to accumulate a predetermined number of fitments 12 in a line. The fitment deliverer 32 is positioned with respect to the conveyor 30 so as to individually drop the fitments 12 into one of the plurality of carriers 38. The fitment heater 34 is disposed downstream from the fitment deliverer 32. The fitment heater 34 is configured to emit heat. The fitment heater 34 is positioned with respect to the conveyor 30 so as to heat the fitments 12 to a predetermined temperature. The fitment inserter 36 is disposed downstream from the fitment heater 34. The fitment inserter 36 includes an arm support 42 and a pair of fitment grippers 44 (See FIGS. 6A-6D). The fitment inserter 36 is positioned with respect to the conveyor 30 so as to pick up a fitment 12 off each one of the plurality of carriers 38 and insert the fitment 12 into the open pouch 14.

The conveyor 30 is configured to move the carriers 38 in a loop. However, it should be appreciated that any conveyor configured to carry an item in a loop currently known and used in the art may be adapted for use herein. For illustrative purposes, the conveyor 30 is shown as a chain 46 having three chain drives 48. Any chain drive 48 currently known and used in the art may be adapted for use herein. The loop is shown as having a generally triangular dimension having a first side leg 50, a second side leg 52 and a base leg 54. One of the chain drives 48 is mounted to one end of the loop where the first and second side legs 50, 52 connect and the other chain drives 48 are spaced apart from each other and are generally coaxial to each other so as to form the base leg 54 of the loop.

The fitment deliverer 32 is disposed on the first side leg 50. The fitment heater 34 is disposed on the second side leg 52. The fitment inserter 36 is disposed on the base leg 54. The conveyor 30 is configured to move the carrier 38 from the fitment deliverer 32 to the fitment heater 34, from the fitment heater 34 to the fitment inserter 36 and from the fitment inserter 36 back to the fitment deliverer 32. At the fitment deliverer 32 the carriers 38 are empty and a fitment 12 is dropped into the carrier 38. The carrier 38 is then moved to the fitment heater 34 where the fitment 12 is heated to a predetermined temperature. The warmed fitment 12 is then moved to the fitment inserter 36 where the heated fitment 12 is picked off the carrier 38 and sealed to the pouch 14. The conveyor 30 is configured to rotate in a clockwise direction so as to move the carrier 38 to the fitment deliverer 32, fitment heater 34, fitment inserter 36 and back to the fitment deliverer 32 in the sequence described above.

The carriers 38 are fixedly mounted to the chain 46. The carriers 38 are generally equidistant away from each other. The carriers 38 are configured to receive a fitment 12 from the fitment deliverer 32. Specifically, the carriers 38 are configured to catch the fitment 12 as the fitment 12 is dropped form the fitment deliverer 32. The carrier 38 includes a base 56 mounted to the conveyor 30. The base 56 is a generally rectangular block formed of a durable and rigid material such as steel. The base 56 has a top surface 58 configured to accommodate the dimensions of the fitment 12. The carrier 38 includes four prongs 60 which project upwardly from the top surface 58 and are shown generally disposed on each corner of the top surface 58. The prongs 60 are generally elongated members and the ends of each prong may be bent outwardly with respect to the center of the top surface of the base so as to provide additional tolerance for catching the fitment 12. It should be appreciated that the prongs 60 have a sufficient length to help guide the fitment 12 as it falls onto the base and the prongs 60 further assist in keeping the fitment 12 in a generally upright position.

The conveyor 30 may be controlled by a programmable logic controller 62 configured to drive the chain 46 along the loop. Preferably, the chain 46 is indexed so as to move a predetermined distance which allows the carriers 38 to stop at the fitment delivery system 10 and the fitment inserter 36. Further, indexing the movement of the chain 46 allows the carriers 38 and the fitments 12 held therein to be exposed to the heat emitted from the fitment heater 34.

With reference again to FIG. 1, the fitment delivery system 10 is disposed along the first side leg 50 of the loop. The chain 46 is driven in a counter clockwise direction as indicated by the arrow, and the fitment heater 34 is disposed downstream the fitment delivery system 10. Thus, fitments 12 are dropped in a carrier 38 at the fitment deliverer 32 and are carried to the fitment heater 34. The fitments 12 are heated and then carried to the fitment inserter 36 which is downstream the fitment heater 34. The fitment inserter 36 picks a fitment 12 off of the carrier 38 and inserts the fitment 12 into the pouch 14. Thus, carriers 38 arriving at the fitment delivery system 10 are empty and ready to receive another fitment 12.

It should be appreciated that the operation of the conveyor 30, the fitment heater 34, the fitment inserter 36 and the fitment delivery system 10 may all be controlled by the programmable logic controller 62. Thus, the movement of the chain 46, and the actions of the fitment deliverer 32, fitment heater 34 and fitment inserter 36 are synchronized so as to allow for the smooth and undisrupted manufacturing of the pouch 14.

Figure 3:
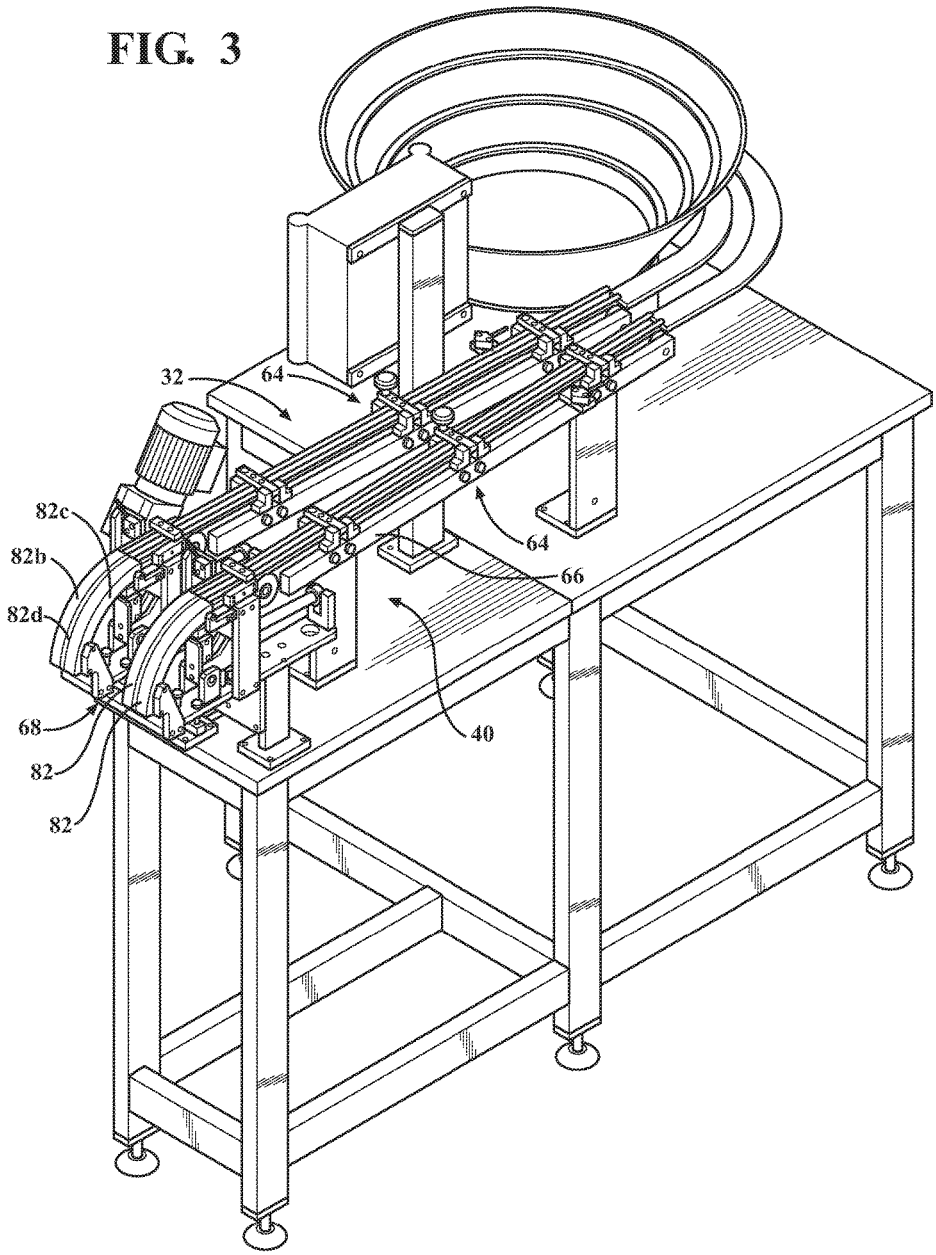
FIG. 3 is an isolated view of the fitment deliverer.
Figure 4:
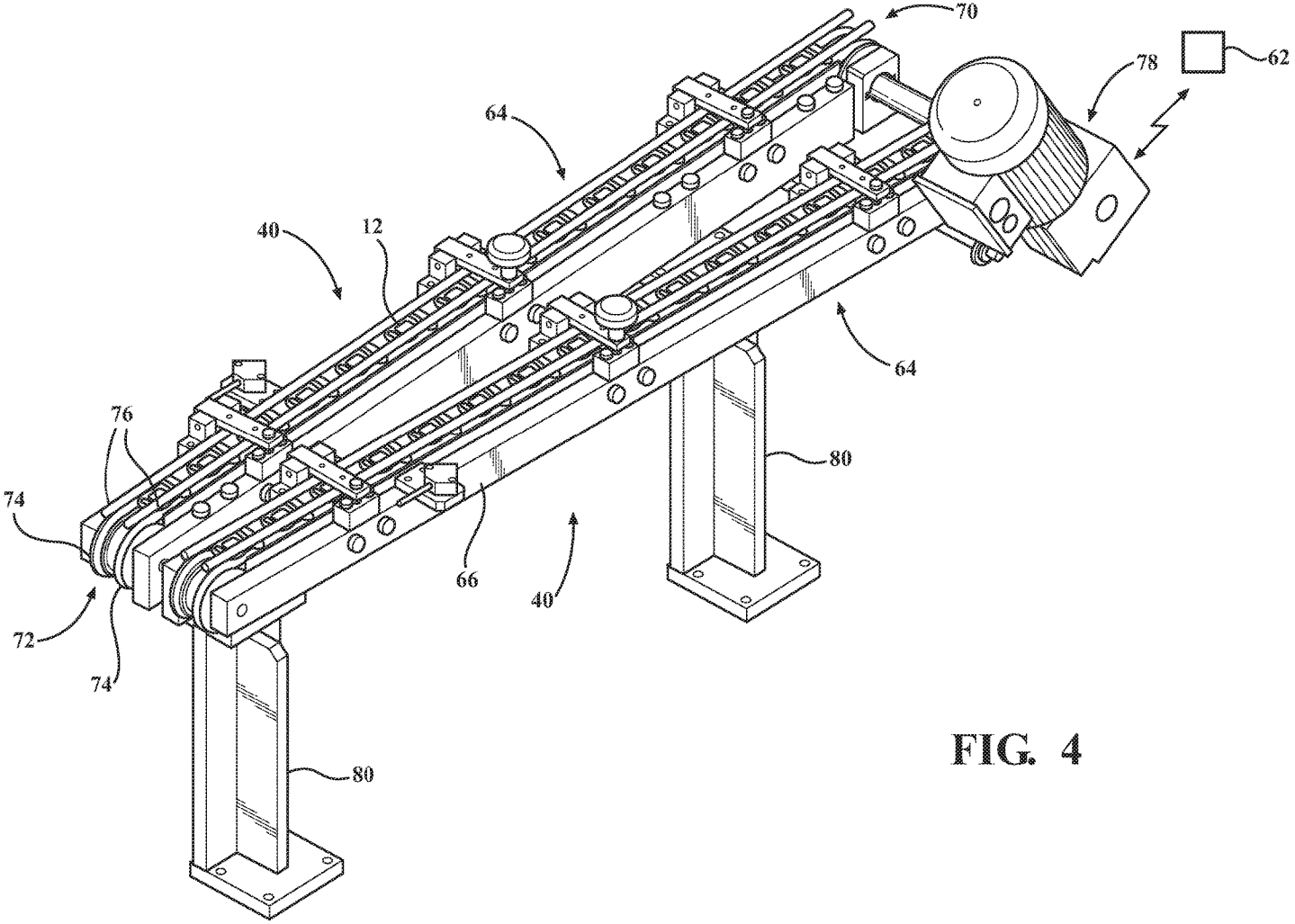
FIG. 4 an isolated view of the elongated portion of the fitment deliverer.

With reference now to FIGS. 3 and 4, a fitment deliverer 32 is provided. The fitment deliverer 32 is configured to accumulate a predetermined number of fitments 12 in a line and individually drop the fitments 12 into an empty carrier 38. The fitment deliverer 32 includes a chute 40. For illustrative purposes, the chute 40 is shown as having two lanes 64. Each lane 64 is coupled to a respective output channel of the bowl feeder 16. The chute 40 is configured to hold a plurality of fitments 12 in a line so as to allow the fitments 12 delivered by the bowl feeder 16 to accumulate therein. However, it should be appreciated that the fitment deliverer 32 is configured to receive fitments 12 from the bowl feeder 16, and thus the fitment deliverer 32 would have a number of chutes 40 corresponding to the number of channels 22 the bowl feeder 16 has. Thus, in instances where the bowl feeder 16 has only one channel 22, the fitment deliverer 32 would have only one chute 40.

Each lane 64 includes an elongated portion 66 configured to allow a predetermined number of fitments 12 to be stored therein. The elongated portion 66 includes a proximal end configured to receive fitments 12 from a corresponding output channel 22. The chute 40 further includes an arcuate end portion 68 disposed on the distal end of the elongated portion 66 so as to allow the fitment 12 to drop into the carrier 38. The bowl feeder 16 feeds fitments 12 into the elongated portion 66. The elongated portion 66 is angled so as to allow gravity to assist in feeding the fitments 12 towards the arcuate end portion 68.

With reference now to FIG. 4, an isolated view of the elongated portion 66 of the chute 40 is provided. FIG. 4 shows two elongated portions 66, each are similar to the other and thus an explanation of one is sufficient to describe the other. The elongated portion 66 is configured to guide the fitment 12 towards the arcuate end portion 68. The elongated portion 66 includes a track 70 which helps guide the fitment 12 and maintain the fitment 12 in a predetermined position so as to be ready for pouch 14 assembly steps. In the instant case, it is preferable to have the fitments 12 standing upright so that the fitment inserter 36 may place the base of the fitment 12 into the opening of the pouch 14. Accordingly, the track 70 is configured to feed the fitment 12 into the arcuate end portion 68 with the base positioned downstream of the spout.

The fitment deliverer 32 includes a fitment feeder 72 configured to move the fitments 12 down the track 70. In an illustrative embodiment, the fitment feeder 72 is a pair of belts 74 formed in a loop and extending the length of the track 70. The track 70 includes a pair of spaced apart bars 76 disposed above the pair of belts 74. As shown, the sides of the fitment 12 are held between a respective bar and belt 74. The belt 74 is rotated by a belt drive 78 thus moving the fitment 12 towards the distal end of the elongated portion 66 as shown in FIG. 4. The elongated portions 66 are mounted to a pair of elongated portion stands 80, one of the elongated portion stand 80 is taller than the other. Specifically, the elongated portion stand 80 supporting the proximal end of the elongated portion 66 is taller than the elongated portion stand 80 supporting the distal end of the elongated portion 66.

The belt drive 78 may be controlled by the programmable logic controller 62 or may be continuously running. The belt 74 provides a friction engagement with the fitment 12 driving the fitment 12 towards the distal end of a respective track 70. The fitments 12 are thus continuously building up along the track 70 as the bowl feeder 16 feeds the fitments 12 to the chute 40. The bars are spaced apart from the belt 74 so as to allow the fitments 12 to remain in contact with the belt 74 but without pinching the belt 74 or otherwise loading the belt 74 in such a manner as to place an undue load on the belt drive 78.

Figure 5:
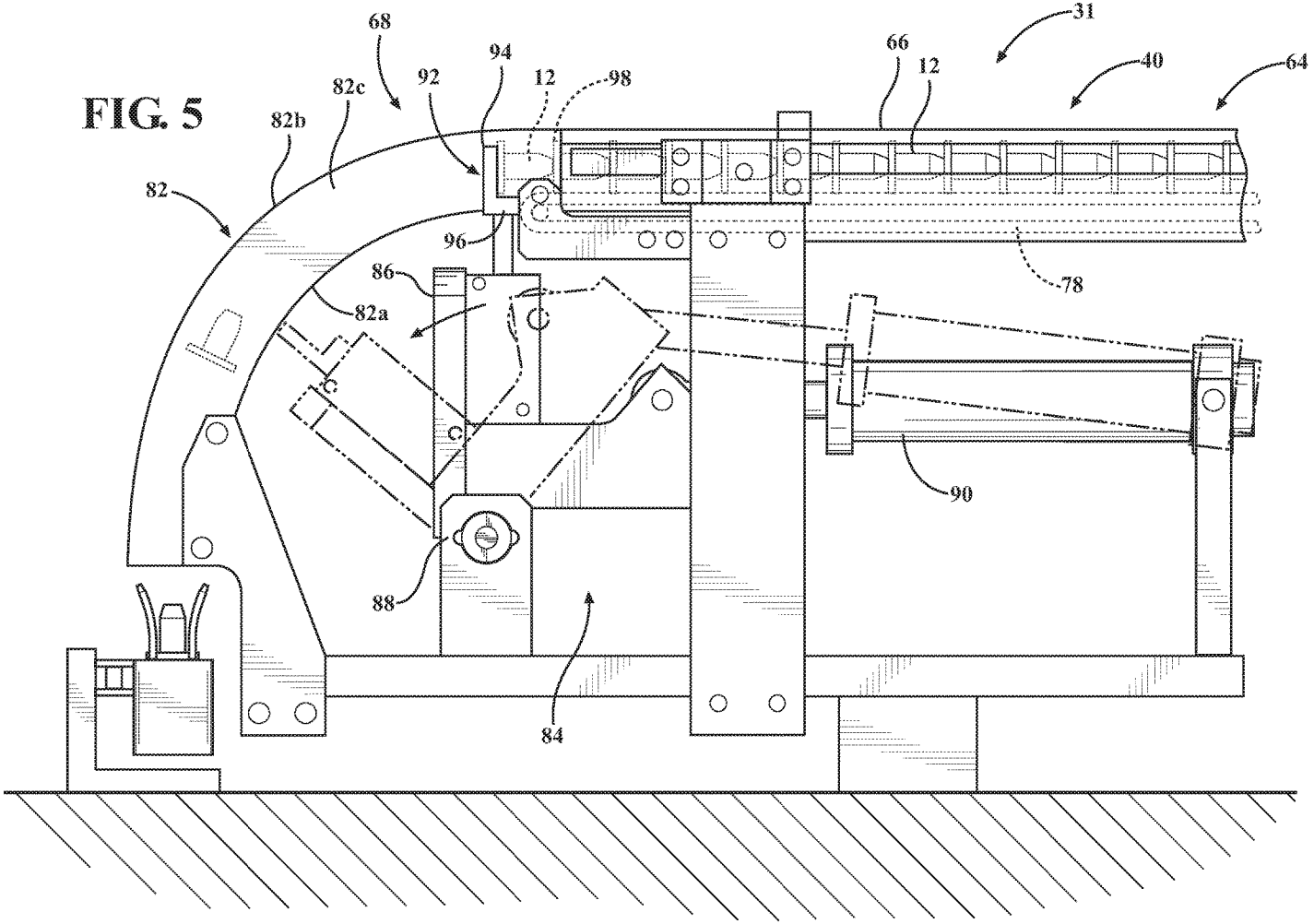
FIG. 5 is a side view of the fitment deliverer shown in FIG. 3.

With reference again to FIG. 3 and now to FIG. 5, a perspective and an isolated view of an illustrative example of the arcuate end portion 68 is provided. The arcuate end portion 68 is configured to slidingly support the fitment 12 so as to maintain the position of the fitment 12 as it is dropped into the carrier 38. In a preferred embodiment the arcuate end portion 68 includes a pair of spaced apart guides 82 configured to slidingly support the sides of the fitment 12. The guides 82 have a generally U-shaped cross section having a back wall 82*a* spaced apart from a front wall 82*b*. A side wall 82*c* is disposed between the back wall 82*a* and the front wall 82*b* so as to define an opening 82*d*. The opening 82*d* of the guides face each other. The guides 82 are arcuate so as to transition the fitment 12 from a generally horizontal position to an upright position.

With reference again to FIG. 5, the fitment deliverer 32 further includes a dispensing mechanism 84. The dispensing mechanism 84 is configured to maintain the accumulation of fitments 12 within a respective track 70 and individually release a fitment 12 down the arcuate end portion 68 for gravity fed delivery into the carrier 38. The dispensing mechanism 84 is illustratively shown as having a guide arm 86 rotatable about a guide arm support 88. A guide arm drive 90, drives the guide arm 86 forward, rotating the guide arm 86 about the guide arm support 88.

The distal end of the guide arm 86 includes a keeper 92. The keeper 92 is configured to retain a fitment 12 and release the fitment 12 down the arcuate end portion 68 and into the empty carrier 38. The keeper 92 includes a back stop 94 and a fitment support 96. The back stop 94 is generally orthogonal to the fitment support 96. The fitment support 96 is configured to support the fitment 12 in a generally horizontal platform. The back stop 94 is configured to prevent the fitment 12 from slipping out of the keeper 92 when advanced by the belt 74.

A gate 98 is disposed adjacent the proximal end of the arcuate end portion 68. The gate 98 is configured to open so as to allow one fitment 12 to advance into the keeper 92. Thus, as the belt 74 is rotated the fitment 12 is urged downstream the track 70 of the elongated portion 66 into the arcuate end portion 68. The gate 98 is opened long enough to allow the fitment 12 to pass into the keeper 92 and then is closed.

The guide arm drive 90 drives the guide arm 86 forward, rotating the guide arm 86 about the guide arm support 88 wherein the keeper 92 is moved along the arcuate end portion 68 carrying with it the fitment 12. When the guide arm 86 is adjacent the proximal end of the arcuate end portion 68, the keeper 92 is retreated removing the back stop 94 from underneath the fitment 12 when the fitment 12 is in a generally upright position. As the back stop 94 is removed, the fitment 12 is held within the chute 40 by a back wall 82*a* of the guides. Accordingly, the fitment 12 is able to free fall out of the distal end of the arcuate end portion 68 into the carrier 38.

With reference again to FIG. 1, the conveyor 30 moves the carrier 38 with the fitment 12 downstream the loop to the fitment heater 34. The fitment heater 34 is disposed along the second side leg 52 of the loop. The conveyor 30 carries carriers 38 holding a fitment 12 past the fitment heater 34. The fitment heater 34 is a heating unit having a heat emitting surface 100 disposed a predetermined distance from the path of the conveyor 30. In a preferred embodiment the heater unit is configured to heat the fitment 12 to temperature between 120-150 degrees Fahrenheit. It should be appreciated that the desired temperature may vary based upon the material the fitment 12 is made of and the sealing conditions used when sealing the fitment 12 to the pouch 14. It should also be appreciated that the time that the carrier 38 is exposed to the fitment heater 34 will also affect how the fitment 12 will achieve the desired temperature.

The conveyor 30 then moves the carrier 38 past the fitment heater 34 to the fitment inserter 36. The fitment inserter 36 is disposed between the conveyor 30 and a pouch forming system 18. The pouch forming system 18 includes pouch grippers 102 configured to hold the pouch 14. The pouch forming system 18 further includes a pouch opening station 24 and a fitment sealing station 26. The pouch 14 is opened so as to receive a fitment 12 and is then transferred to the fitment sealing station 26 wherein the fitment inserter 36 picks a fitment 12 from the carrier 38 and places the fitment 12 into the pouch 14 opening wherein the fitment sealing station 26 seals the fitment 12 thereto.

With reference now to FIGS. 6A through 6D a perspective view of the fitment inserter 36 is provided. The fitment inserter 36 includes an arm support 42 rotatably mounted to a piston 104. For illustrative purposes, the arm support is shown as having two elongated members 42*a*, 42*b*. Each elongated member 42*a* includes a fitment gripper 44. However, the depiction is configured for use with a pouch forming machine 18 which provides two open pouches configured to receive a fitment. Accordingly, it should be appreciated by those skilled in the art that the arm support 42 may have only one elongated member or more elongated members based upon the number of pouches the pouch forming machine is capable of sealing a fitment to. However, in any embodiment the fitment inserter 36 operates in the same general manner as described below.

An arm support drive 106 rotates the arm support 42 one hundred and eighty (180) degrees so as to move the ends of the arm support 42 between the carrier 38 and the fitment sealing station 26. The piston 104 is configured to drive the arm support 42 between an up and down position. In the down position one of the pair of fitment grippers 44 is configured to pick up a fitment 12 off the carrier 38 and the other of the pair of grippers 44 is configured to insert a fitment 12 into the open pouch 14.

The fitment grippers 44 are configured to pick up a fitment 12 from the carrier 38 and also insert a fitment 12 into an opening of the pouch 14. The fitment grippers 44 include an elongated body 108 having an end portion 110 configured to engage the fitment 12. For illustrative purposes only, the fitment grippers 44 include a suction tube 112 configured to pick up the fitment 12 by vacuum pressure. The elongated body 108 includes a central passage in fluid communication with the suction tube 112 for which air may be drawn. However, it should be appreciated that other means of picking up the fitment 12 currently known and used may be adapted for use herein, illustratively including a pair of closable and openable fingers. In another alternative embodiment, the end portion 110 of the fitment gripper 44 includes having a slit configured to engage a fin of a fitment.

With reference now to FIGS. 6A-6D the operation of the fitment inserter 36 is provided. The piston 104 moves the arm support 42 between an up and down position. In the down position, each of the fitment grippers 44 holds a fitment 12. One of the fitment grippers 44 grabs a fitment 12 from the carrier 38 and the other of the fitment grippers 44 places a fitment 12 within an opening of the pouch 14. The fitment inserter 36 leaves the arm support 42 in the down position long enough to allow the fitment sealing station 26 to seal the fitment 12 to the pouch 14. The fitment inserter 36 moves the arm support 42 to the up position wherein the fitment 12 sealed to the pouch 14 remains held by the pouch gripper 102 and is released by the corresponding fitment gripper 44. Simultaneously, the fitment 12 in the carrier 38 is picked up by the corresponding fitment gripper 44.

The arm support 42 is then rotated 180 degrees thus the empty gripper is positioned above the conveyor 30, simultaneously, the conveyor 30 is indexed so as to move a carrier 38 with a fitment 12 generally underneath the empty fitment gripper 44. The fitment gripper 44 hold a fitment 12 is positioned above the pouch 14 forming station. As the arm support 42 is turned, the pouch forming system 18 moves an open pouch 14 to the fitment sealing station 26. It should be appreciated that movement of the conveyor 30, pouch 14 system, and fitment inserter 36 are synchronized such that an empty fitment gripper 44 is positioned above a carrier 38 holding a fitment 12 and the fitment gripper 44 holding a fitment 12 is position above an open pouch 14.

The arm support 42 is then moved to the down position wherein the empty fitment gripper 44 engages a fitment 12 from the carrier 38 and the fitment gripper 44 carrying a fitment 12 places the fitment 12 into the opening of the pouch 14. The fitment 12 is then sealed to the pouch 14 and the cycle continues as described above.

Figure 6A:
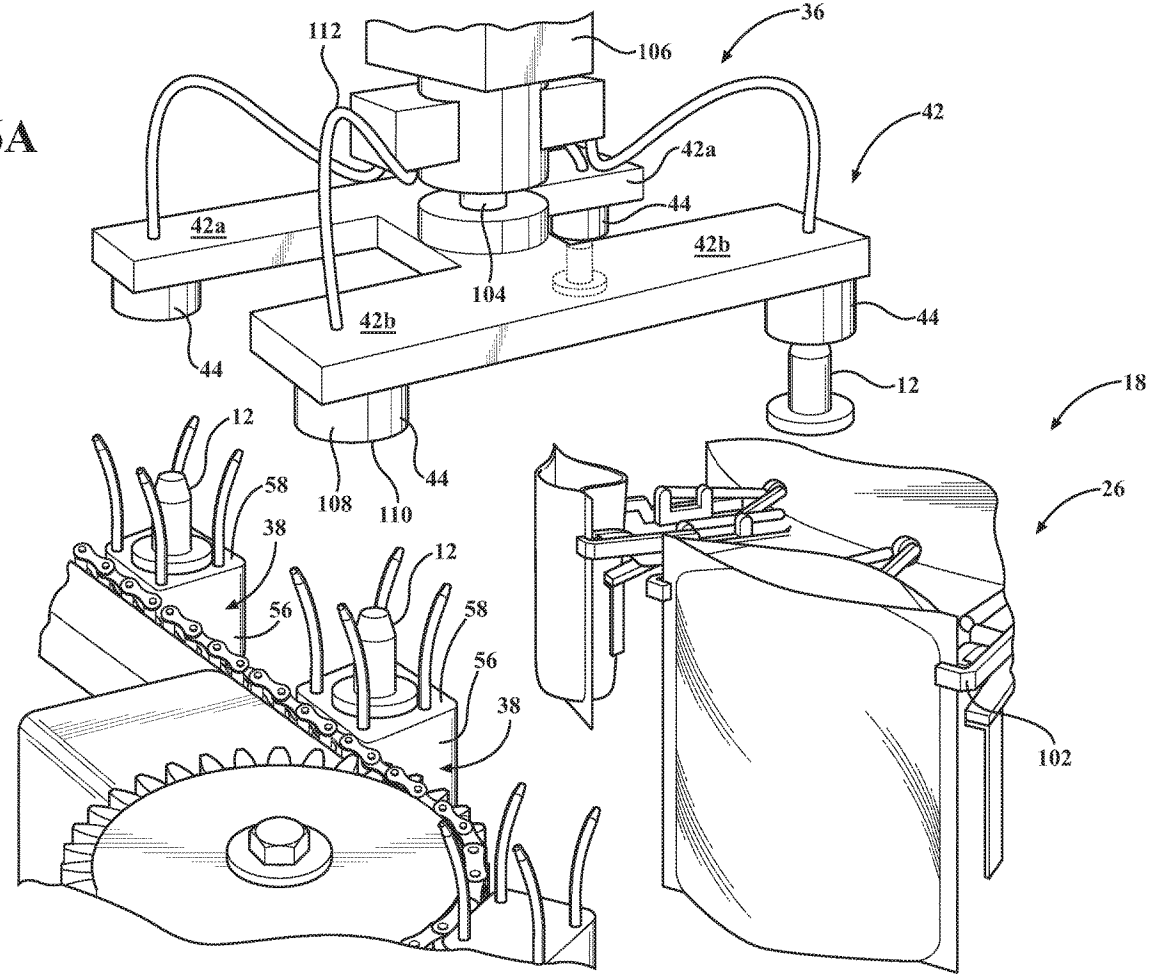
FIG. 6A shows the fitment inserter with the arm support in the up position.
Figure 6B:
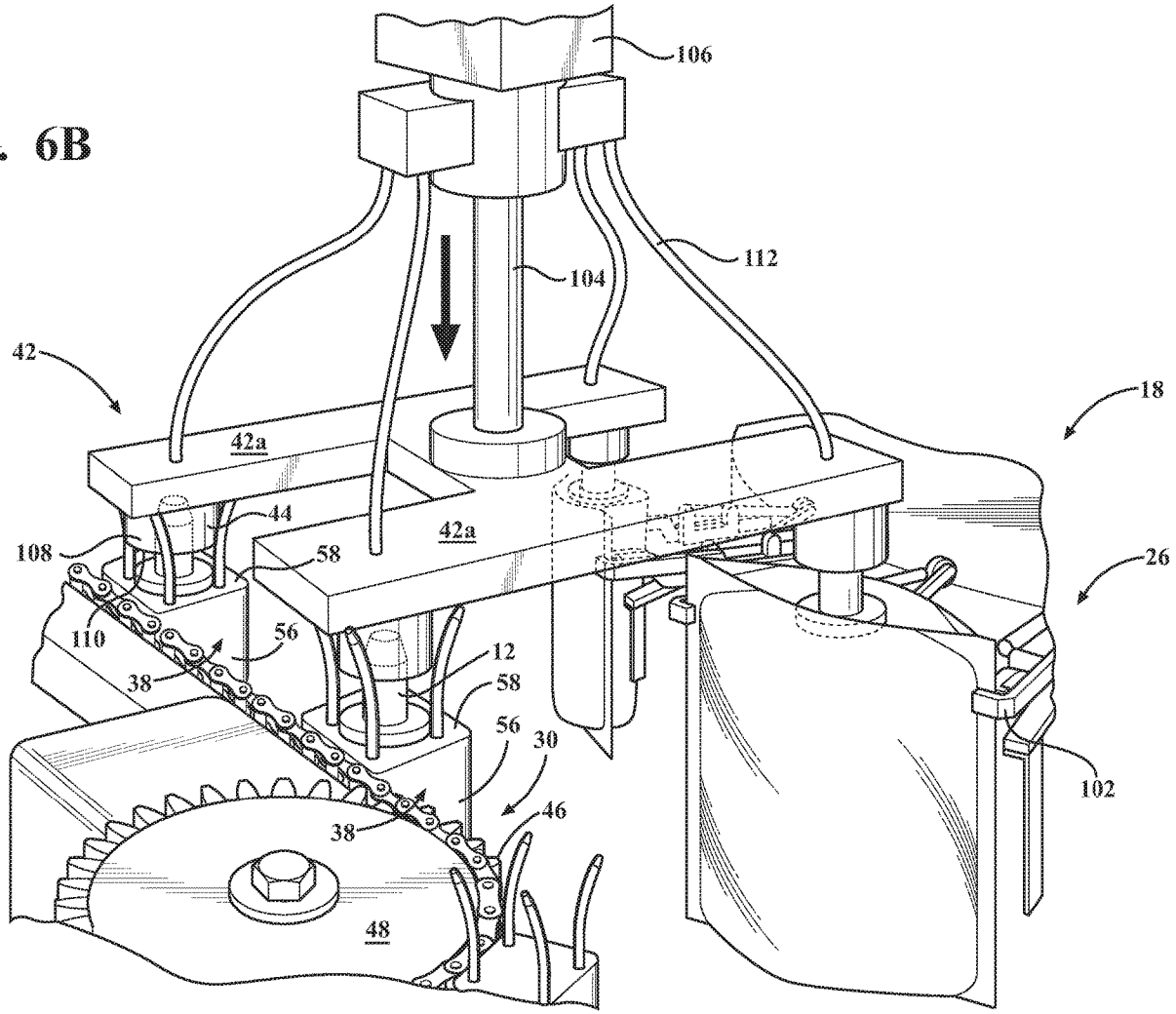
FIG. 6B shows the fitment inserter with the arm support moved to the down position relative to FIG. 6A.
Figure 6C:
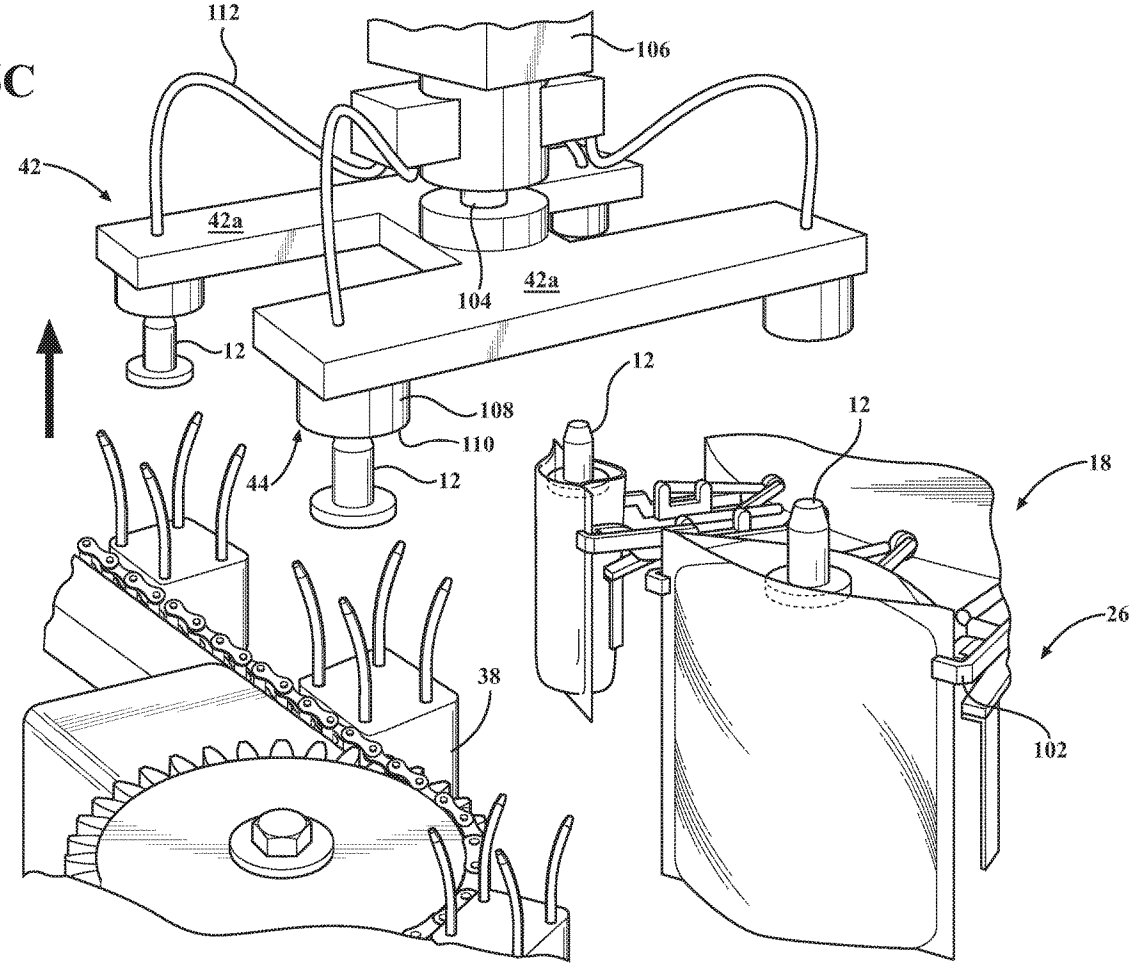
FIG. 6C shows the fitment inserter with the arm support moved to the up position relative to FIG. 6B.
Figure 6D:
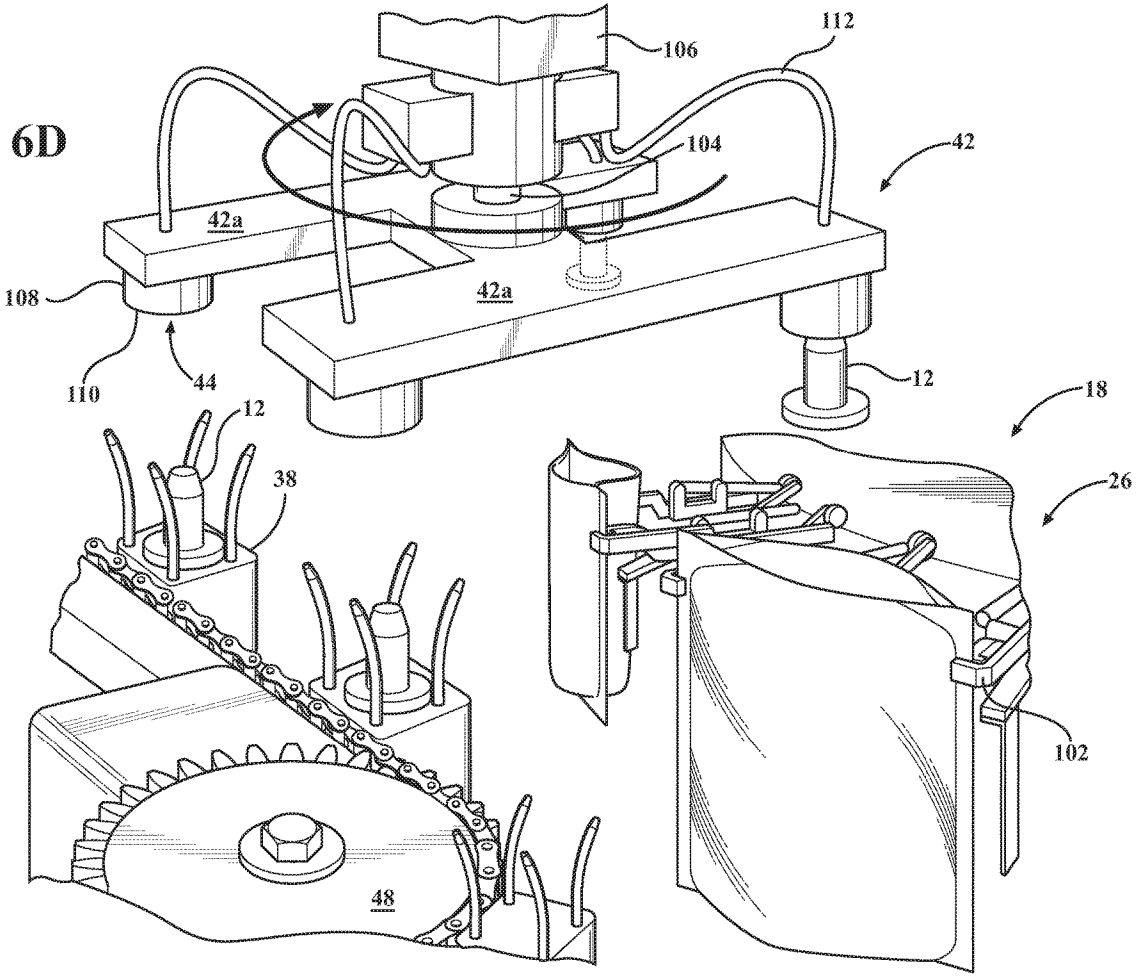
FIG. 6D shows the fitment inserter with the arm support rotated 180 degrees relative to FIG. 6C.

FIG. 6A shows the arm support 42 in the up position, wherein a pair of the fitment grippers 44 are empty and disposed above carriers 38 holding fitments. Another pair of fitment grippers 44 are opposite the other pair and disposed above a pair of open pouches 14. With reference now to FIG. 6B, the arm support 42 is driven to the down position. The fitment grippers 44 above the carrier 38 have engaged a pair of fitments 12. The fitments 12 may be held to a respective fitment gripper 44 by a vacuum pressure provided by the suction tube 112. The other pair of fitment grippers 44 have disposed their respective fitments 44 into an open pouch 14. FIG. 6C shows the arm support moved to the up position. The fitment grippers 44 have picked up a respective fitment 12 off of the carrier 38. The pouch forming station 18 has sealed the fitments 12 to the pouch 14. It should be appreciated that seal bars (not shown) have come in to seal the fitments 12 to the pouch 14. The fitments 12 are held within the pouch 12 as the fitment grippers 44 are moved up by the arm support 42. With reference now to FIG. 6D, the conveyor 30 has been indexed forward so as to bring a pair of carriers 38 holding fitments 12 to the fitment inserter 36. Simultaneously, the pouch forming machine 18 has advanced a pair of open pouches to the fitment sealing station 26. The arm support 42 is rotated 180 degrees as indicated by the arrow and the empty fitment grippers 44 are positioned above the carriers 38 and ready to pick up their respective fitment 12. Simultaneously, the fitment grippers 38 holding fitments 12 are ready to place their respective fitment 12 into a corresponding open pouch 14.

Accordingly, the fitment delivery system 10 is configured to reduce down time for manufacturing pouches 14 with fitments 12 by providing a chute 40 for which fitments 12 may accumulate, improves the process of sealing the fitment 12 to the pouch 14 by preheating the fitment 12 before the sealing process, and increases the efficiency of pouch 14 formation by having a single device configured to both pick up and insert a fitment 12 into the pouch 14.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

The invention claimed is:

1. A fitment delivery system for delivering a fitment to an open pouch, the fitment adapted to be sealed to the open pouch, the fitment delivery system comprising:

a conveyor disposed along a loop;

a plurality of carriers mounted to the conveyor, wherein each of the plurality of carriers includes a base having a top surface, and a plurality of prongs extending upwardly from the top surface of the base, the plurality of prongs are spaced apart from each other so as to define a space to accommodate the fitment;

a fitment deliverer including a chute configured to accumulate a predetermined number of fitments in a line, the fitment deliverer positioned with respect to the conveyor so as to individually drop each fitment into the space of one of the plurality of carriers, the chute having an elongated portion having a track;

a fitment feeder which guides the fitments down the track, the fitment feeder includes a pair of belts and a belt drive, each belt is in a loop extending the length of the track, the track includes a pair of spaced apart bars disposed above the belts, the belts are rotated by the belt drive to move the fitment toward a distal end of the elongated portion of the chute;

a fitment heater disposed downstream from the fitment deliverer, the fitment heater configured to emit heat, the fitment heater positioned with respect to the conveyor so as to heat the fitment to a predetermined temperature; and a fitment inserter disposed downstream from the fitment heater, the fitment inserter having an arm support, a pair of fitment grippers mounted on opposite ends of the arm support, the fitment inserter positioned with respect to the conveyor so as to pick up a fitment off one of the plurality of carriers and insert the fitment into the open pouch.

2. The fitment delivery system set forth in claim 1, wherein the prongs are generally elongated members and an end of each prong is bent outwardly with respect to a center of the top surface of the base so as to provide additional tolerance for catching the fitment.

3. The fitment delivery system set forth in claim 1, wherein the chute includes an arcuate end portion disposed on the distal end of the elongated portion, the elongated portion includes a proximal end configured to receive fitments from a corresponding output channel.

4. The fitment delivery system set forth in claim 3, wherein the elongated portion is angled so as to allow gravity to assist in feeding the fitments towards the arcuate end portion.

5. The fitment delivery system of claim 1, wherein the fitment heater has a heat emitting surface disposed a predetermined distance from the conveyor.

6. The fitment delivery system of claim 5, wherein the fitment heater is configured to heat the fitment to a temperature between 120-150 degrees Fahrenheit.

7. The fitment delivery system of claim 1, wherein the fitment inserter further includes a piston, the arm support rotatably mounted to the piston, the piston configured to move the arm support between an up and a down position, wherein in the down position one of the pair of grippers is configured to pick up one fitment off the carrier and the other one of the pair of grippers is configured to insert another fitment into an open pouch.

8. The fitment delivery system of claim 7, wherein each of the pair of fitment grippers includes an elongated body having an end portion configured to engage the fitment.

9. The fitment delivery system of claim 8, wherein the end portion includes a slit, each of the pair of fitment grippers includes a suction tube configured to pick up the fitment by vacuum pressure, and the elongated body includes a central passage in fluid communication with the suction tube.

10. A fitment delivery system for delivering a fitment to an open pouch, the fitment adapted to be sealed to the open pouch, the fitment delivery system comprising:

a conveyor disposed along a loop;

a plurality of carriers mounted to the conveyor, wherein each of the plurality of carriers includes a base having a top surface, and a plurality of prongs extending upwardly from the top surface of the base, the plurality of prongs are spaced apart from each other so as to define a space to accommodate the fitment;

a fitment deliverer including a chute configured to accumulate a predetermined number of fitments in a line, the fitment deliverer positioned with respect to the conveyor so as to individually drop each fitment into the space of one of the plurality of carriers;

wherein the chute includes an elongated portion and an arcuate end portion disposed on the distal end of the elongated portion, the elongated portion includes a proximal end configured to receive fitments from a corresponding output channel;

a dispensing mechanism configured to maintain the accumulation of fitments within the elongated portion and individually release one fitment down the arcuate end portion for gravity fed delivery into the carrier;

wherein the dispensing mechanism includes a guide arm rotatable about a guide arm support, and a guide arm drive, the guide arm drive drives the guide arm forward, rotating the guide arm about the guide arm support;

a fitment heater disposed downstream from the fitment deliverer, the fitment heater configured to emit heat, the fitment heater positioned with respect to the conveyor so as to heat the fitment to a predetermined temperature; and a fitment inserter disposed downstream from the fitment heater, the fitment inserter having an arm support, a pair of fitment grippers mounted on opposite ends of the arm support, the fitment inserter positioned with respect to the conveyor so as to pick up a fitment off one of the plurality of carriers and insert the fitment into the open pouch.

11. The fitment delivery system set forth in claim 10, further including a keeper disposed on a distal end of the guide arm, the keeper is configured to retain a fitment and release the fitment down the arcuate end portion and into an empty carrier.

12. The fitment delivery system of claim 11, wherein the keeper includes a back stop and a fitment support, the back stop is generally orthogonal to the fitment support, and the fitment support is configured to support the fitment in a generally horizontal plane, the guide arm pivoting the fitment support from the horizontal plane to a generally vertical plane, wherein the fitment is able to clear the back stop and free fall out of the distal end of the arcuate end portion into the carrier.

* * * * *